United States Patent [19]

Melfi et al.

[11] Patent Number: 4,462,573

[45] Date of Patent: Jul. 31, 1984

[54] SUPPORT POST FOR TEMPORARY GUARD-RAIL CHAINS

[75] Inventors: Samuel T. Melfi, 520 NE. Wavecrest Ct., Boca Raton, Fla. 33432; Nicholas J. Melfi, 680 SW. 14th St., Deerfield Beach, Fla. 33441

[73] Assignees: Samuel T. Melfi; Anna J. Melfi, both of Boca Raton; Nicholas J. Melfi, Deerfield Beach, all of Fla. ; a part interest

[21] Appl. No.: 525,292

[22] Filed: Aug. 22, 1983

[51] Int. Cl.[3] ..... E04H 17/14

[52] U.S. Cl. ..... 256/65; 24/129 R; 403/343

[58] Field of Search ..... 256/DIG. 6, 59, 23, 256/1, DIG. 5, 65; 403/343, 320; 24/129 R, 129 C; 248/499; 114/218

[56] References Cited

U.S. PATENT DOCUMENTS

| | | | |
|---|---|---|---|
| 807,189 | 12/1905 | McCarthy | 256/59 X |
| 3,406,946 | 10/1968 | Saultz | 256/DIG. 6 |
| 3,661,360 | 5/1972 | Windham | 256/DIG. 6 |
| 4,045,003 | 8/1977 | McCluskey et al. | 256/59 |

*Primary Examiner*—Andrew V. Kundrat

*Attorney, Agent, or Firm*—Oltman and Flynn

[57] ABSTRACT

A post for supporting upper and lower temporary guard-rail chains around the periphery of a concrete floor slab on a building under construction. The post has two vertically spaced pairs of hooks to which respective chains may be attached so as to make it virtually impossible to dislodge either chain accidentally. The post has a screw-threaded rod for insertion in a wire nut embedded in the floor slab. A clamping nut on this rod is adjustable to clamp the post in a position in which the hooks are on the side of the post away from the periphery of the floor slab.

11 Claims, 8 Drawing Figures

SUPPORT POST FOR TEMPORARY GUARD-RAIL CHAINS

SUMMARY OF THE INVENTION

This invention relates to a support post for temporary guard-rail chains on a building under construction, particularly at a balcony.

Multi-story buildings often are constructed with balconies which extend out from the side of the building. Typically, after the concrete floor slab for the balcony has been poured in place on the outside of the building and has hardened, the workmen will stand and move about on that floor slab in performing other work in the construction of the building. This requires a temporary guard-rail supported above and around the perimeter of the floor slab to prevent a workman from falling off accidentally. The same need for a temporary guard-rail may exist at monolithic concrete floor and beam structures and concrete steps in a building under construction.

Commonly, the temporary guard-rail has upper and lower chains which run between support posts extending up from the floor slab at successive locations along its periphery. Such a post may have a screw-threaded lower end which is threadedly received in a nut embedded in the concrete floor slab. Usually, the post has two vertically spaced hooks to which the respective chains are attached individually, and the post is turned to position these hooks facing inward, i.e., away from the periphery of the floor slab.

With just a single hook on each post for each chain there is a possibility that the chain might be accidentally dislodged from the post, creating a hazardous condition for the workers. The present invention is directed to a novel post construction having paired hooks for holding the respective chains so as to virtually eliminate the possibility of either chains becoming disconnected from the post. In addition, the post is constructed to enable it to be conveniently clamped in a position with the paired hooks facing inward after it has been turned to that position.

A principal object of this invention is to provide a novel and improved post for supporting temporary guard-rail chains on a building under construction.

Another object of this invention is to provide such a post having paired hooks for securely holding the chains on the post.

Another object of this invention is to provide such a post with a novel arrangement for clamping it in a position with the hooks facing inward from the periphery of the floor slab on which the post is mounted.

Further objects and advantages of this invention will be apparent from the following detailed description of certain presently preferred embodiments, which are illustrated schematically in the accompanying drawing.

Before explaining the disclosed embodiments of the present invention in detail it is to be understood that the invention is not limited in its application to the details of the particular arrangements shown since the invention is capable of other embodiments. Also, the terminology used herein is for the purpose of description and not of limitation.

DETAILED DESCRIPTION

Figure 1:
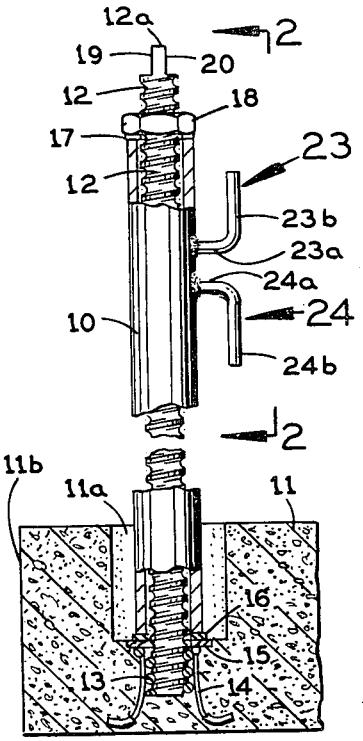
FIG. 1 is an elevational view showing one embodiment of the present invention with parts broken away for clarity.

Referring to FIG. 1, the temporary guard-rail post includes a cylindrical, rigid, steel tube 10 which extends up from a concrete floor 11, such as a balcony floor, in a building under construction. An elongated, rigid, screw-threaded steel rod 12 extends down through the tube 10 and is rotatably received therein. The lower end of rod 12 is screw-threadedly received in a helical wire nut 13 which is embedded in the concrete floor. This nut is attached to downwardly extending feet 14 which rest on the bottom of the form (not shown) into which the concrete for the floor is poured. A flat, annular, steel washer 15 is rigidly attached to the upper end of the wire nut 13. The screw-threaded rod 12 extends down loosely through the central opening in this washer. Above the washer 15 the concrete floor slab 11 is formed with a recess **11*a*** into which concrete will be poured around the lower end of a permanent guard-rail post later in the construction of the building.

The rigid tube 10 carries a flat, annular, steel washer 16 on its lower end which rests on washer 15. Tube 10 has a similar washer 17 on its upper end. Rod 12 extends loosely through the respective central openings in both washers 16 and 17 but is confined by them against substantial lateral movement in the tube.

Figure 2:
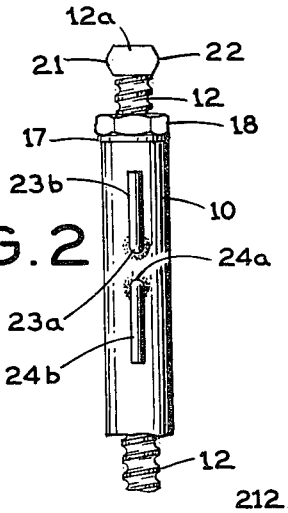
FIG. 2 is a fragmentary elevation taken from the line 2—2 in FIG. 1.

A nut 18 threadedly engages the screw-threaded rod 12 above the upper washer 17. Above this nut the top extremity of rod 12 is cut away to present an upper end segment **12*a* having opposite flat sides 19 and 20 for engagement by the jaws of a wrench which is used to rotate the rod 12. As shown in FIG. 2, between the flats 19 and 20, the end edges of the rod are formed with protrusions 21 and 22 which project laterally beyond the screw-thread on the nut 18 to prevent its removal from the rod 12**.

In accordance with this invention, for each of the two guard rail chains a pair of upper and lower hooks 23 and 24 are located on the side of tube 10 which will face inward (i.e., directly away from the peripheral edge **11*b* of the balcony floor slab and toward the side of the building). Only the paired hooks for the upper guard rail chain are shown, for the sake of simplicity. The upper hook 23 has a short, straight, horizontal inner leg 23*a* which is welded to the outside of tube 10 and extends radially outward from it and a longer, straight, vertical outer leg 23*b* which extends up from the outer end of its inner leg 23*a* at a right angled, rounded bend connecting them. The lower hook 24 has a short, straight, horizontal inner leg 24*a* which is welded to the outside of tube 10 and extends radially outward from it a short distance below, and in vertical alignment with the inner leg 23***a* of the upper hook. The lower hook also has a longer, straight, vertical outer leg 24*b* connected to the outer end of its inner leg 24*a* at a rounded, right-angled bend and extending down from it vertically in alignment with the outer leg 23*b* of the upper hook.

The post assembly, consisting of tube 10 with its attached end washers 16 and 17, threaded rod 12 and nut 18, is positioned upright, with the lower end of the threaded rod 12 threadedly received in the wire nut 13 embedded in the concrete floor slab 11. The rod 12 may be rotated on its vertical axis until its lower end is fully inserted down in the wire nut 13. With the nut 18 loose against the washer 17 on the upper end of tube 10, this tube is rotated on its vertical axis to a position in which the paired hooks 23 and 24 face inward away from the outer edge 11*b* of the balcony floor slab 11, and then the nut 18 is tightened against the top washer 17 to secure the tube 10 in this position. The lower pair of hooks (not shown) are aligned with the hooks 23 and 24 and are the same as these hooks so that these lower hooks also will face inward away from the periphery of the floor slab.

After each of the other post assemblies along the periphery of the balcony floor slab has been similarly positioned, an upper chain C (FIG. 5) may be attached to the upper pair of hooks 23 and 24 on each post assembly. This chain extends substantially horizontally between successive post assemblies and serves as the upper part of a protective guard-rail to prevent a workman from accidentally stepping off the balcony floor slab. A similar lower chain may be attached to the lower pair of hooks on each post to provide the lower part of the guard rail.

Figure 6:
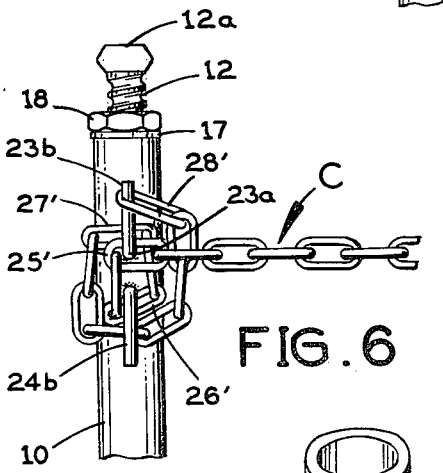
FIG. 6 is a view similar to FIG. 5 and showing the attachment of one end of the chain to the post.
Figure 5:
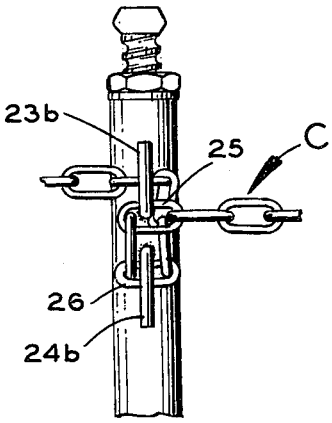
FIG. 5 is a fragmentary elevation showing the attachment of a guard rail chain to a post as shown in FIG. 1 intermediate the opposite ends of the chain.

As shown in FIGS. 5 and 6, the two hooks 23 and 24 on the inwardly-facing side of tube 10 in the post assembly facilitate the attachment of the chain C to the post.

Except at the two posts at either end of the chain, the chain may be applied to the paired hooks 23 and 24 as shown in FIG. 5. The chain is pulled taut and the closest link 25 of the chain is inserted down over the upwardly extending outer leg 23*b* of the upper hook 23 until it extends around the horizontal inner leg 23*a* of this hook. The chain extends down from this link 25 and passes snugly under the horizontal inner leg 24*b* of lower hook 24, at the inside of the depending outer leg 24*a* of this hook, as shown by link 26. Beyond hook 24 the chain extends upward and then across the top of the horizontal inner leg 23*a* of the upper hook 23 behind the latter's outer leg 23*b*, passing closely above the top of link 25. The chain then continues to the left in FIG. 5 to the next support post.

At the final support post (FIG. 6), the chain is pulled taut and the closest link 25' is inserted down over the upwardly extending outer leg 23*b* of the upper hook until it extends around the horizontal inner leg 23*a* of this hook. The chain is bent downward from the upper hook and back under the horizontal inner leg 24*a* of the lower hook behind the depending outer leg 24*b* of this hook, as shown by link 26'. On the other side of hook 24 the chain is bent upward and then horizontally across the top of the inner leg 23*a* of the upper hook behind the outer leg 23*b* of this hook, passing closely above link 25' as shown by link 27' in FIG. 6. Beyond link 27' the chain is again bent downward and back under the horizontal inner leg 24*a* of the lower hook, passing again behind the vertical outer leg 24*b* of this hook closely below link 26'. Then the chain is bent up again to the final link 28', which is slid down over the outer leg 23*a* of the upper hook as far as it will go.

With this arrangement, the chain is attached to every post in such a manner that a force in any direction on the chain will not detach it from the hooks 23 and 24.

Figure 3:
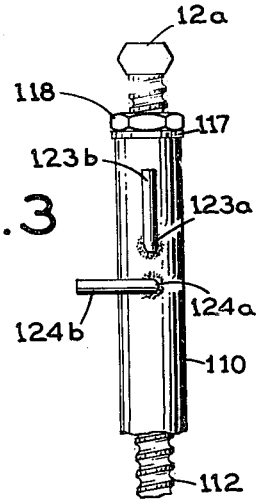
FIG. 3 is a view similar to FIG. 2 and showing a second embodiment of this invention.

FIG. 3 shows a second embodiment which differs from the embodiment of FIGS. 1 and 2 in one respect only: the lower hook of each pair is in a horizontal plane rather than a vertical plane.

Elements in FIG. 3 which correspond to those in FIGS. 1 and 2 are given the same reference numberals plus 100 as those in FIGS. 1 and 2, and the description of these elements need not be repeated. On the lower hook of the pair shown in FIG. 3, the horizontal inner leg 124*a* extends radially from the tube 110 a short distance below the horizontal inner leg 123*a* of the upper hook and the outer leg 124*b* of the lower hook of the same pair extends horizontally to one side or the other of tube 110.

Figure 4:
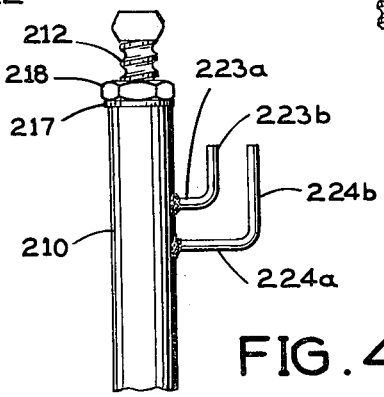
FIG. 4 is a fragmentary elevation showing a third embodiment.

FIG. 4 shows a third embodiment in which both legs of the lower hook extend parallel to the corresponding legs of the upper hook of the same pair of hooks. Corresponding elements in FIG. 4 have the same reference numerals plus 200 as those in FIGS. 1 and 2. The horizontal inner leg 224*a* of the lower hook 224 extends radially out from the tube 210 substantially farther than the horizontal inner leg 223*a* of the upper hook. The outer vertical leg 224*b* of the lower hook extends up from the outer end of its inner leg parallel to the vertical outer leg 223*b* of the upper hook and farther out from tube 210 so that different links of the chain can be inserted on the respective hooks.

Figure 7:
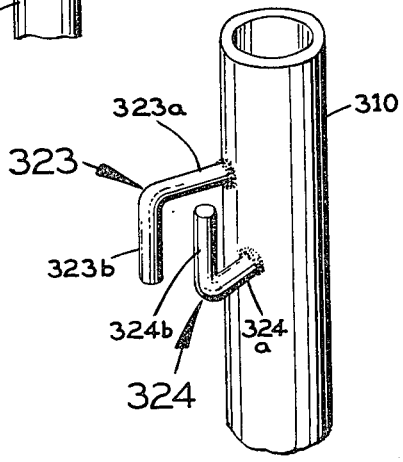
FIG. 7 is a fragmentary perspective view of a fourth embodiment of the invention.

FIG. 7 shows a fourth embodiment of the invention in which the upper and lower hooks of each pair are offset from each other circumferentially of the tube. Corresponding elements of this embodiment have the same reference numerals plus 300 as those in the embodiment of FIGS. 1 and 2. In FIG. 6, the upper hook 323 has its vertical outer leg 323*b* extending down from the outer end of its horizontal inner leg 323*a*. The lower hook 324 has its vertical outer leg 324*b* extending up from the outer end of its horizontal inner leg 324*a*. The inner leg 324*a* of the lower hook is attached to the outside of tube 310 at a location below and several degrees circumferentially away from the attachment of the inner leg 323*a* of the upper hook to the tube, so that the outer legs of the two hooks are spaced from each other to receive different links of the guard-rail chain.

Figure 8:
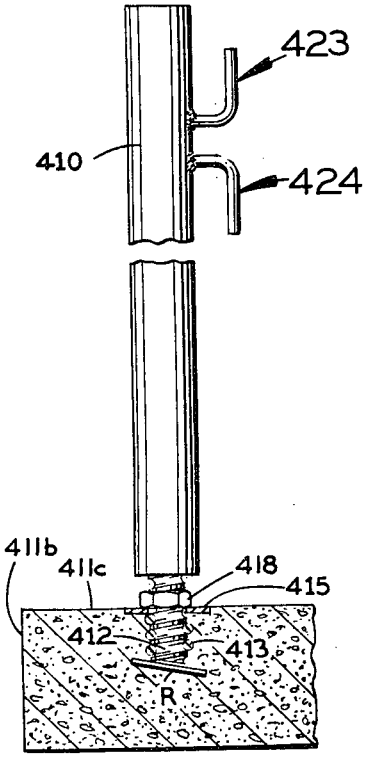
FIG. 8 is a view similar to FIG. 1 and showing a fifth embodiment of the invention.

The embodiment of FIG. 8 has a hook arrangement identical to that shown in FIGS. 1 and 2 but the construction of the post is different. The post 410 is rigidly attached to a short screw-threaded rod 412 extending down from its lower end and threadedly received in a wire nut 413 embedded in the balcony floor slab 411. A steel rod R is welded to the bottom of the wire nut and a flat steel washer 415 to the top. The top of washer 415 is flush with the top 411*c* of the concrete floor slab. A nut 418 is threadedly adjustable on rod 412 to engage the washer 415 on top of wire nut 413 and clamp the post tightly to the wire after the post has been turned to a position in which the hooks 423 and 424 extend inward away from the outer edge 411*b* of the balcony floor slab. The nut 418 is readily accessible to be turned by a suitable wrench.

We claim:

1. In a support post for a temporary guard-rail chain at a concrete floor on a building under construction, said post having a screw-threaded rod for screw-threaded insertion in a nut embedded in the floor, said rod being screw-threadedly removable from said nut after use, the improvement which comprises:

a pair of hooks on one side of said post positioned close enough to each other for engagement by closely-spaced different links of the same temporary guard-rail chain to attach the chain to the post;

and a clamping nut threadedly adjustable on said screw-threaded rod to clamp said post in a position in which said hooks are on the side of the post facing away from the periphery of the floor.

2. A post according to claim 1 and comprising:

a vertically elongated rigid tube rotatably passing said screw-threaded rod and carrying said hooks;

and wherein:

said screw-threaded rod extends from above said tube down through the tube and projects below the lower end of the tube for reception in said nut embedded in the floor;

and said clamping nut threadedly engages said screw-threaded rod above said tube and is adjustable down against the top of the tube to clamp the latter in said position in which the hooks are on the side away from the periphery of the floor.

3. A post according to claim 2, and further comprising rigid flat annular washers on the upper and lower ends of said tube rotatably receiving said screw-threaded rod and confining it laterally.

4. A post according to claim 1 wherein said pair of hooks comprises:

an upper hook extending out from the post and then upward;

and a lower hook extending out from the post and then downward.

5. A post according to claim 1 wherein said pair of hooks comprises:

an upper hook extending out from the post and then upward;

and a lower hook extending out from the post and then laterally.

6. A post according to claim 1 wherein said pair of hooks comprises:

an upper hook extending out from the post and then upward;

and a lower hook extending out from the post and then upward.

7. A post according to claim 1 wherein said pair of hooks comprises:

an upper hook extending out from the post and then downward;

and a lower hook offset from the upper hook circumferentially of the post and extending out from the post and then upward.

8. A post according to claim 1 wherein said pair of hooks comprises an upper hook and a lower hook joined to said post at vertically aligned locations.

9. A post according to claim 1 wherein said pair of hooks comprises an upper hook and a lower hook joined to said post at locations which are offset from each other circumferentially of the post.

10. A post according to claim 1 and comprising:

a vertically elongated rigid tube rigidly attached to said screw-threaded rod and extending upward from it and carrying said hooks;

and wherein:

said clamping nut threadedly engages said screw-threaded rod below said tube and is adjustable down against said nut in the floor.

11. A post according to claim 1, and further comprising a second pair of hooks on the post which are vertically spaced from and substantially aligned with said first-mentioned pair of hooks, said second pair of hooks being substantially the same as said first-mentioned pair of hooks for holding a second temporary guard-rail chain spaced vertically from said first-mentioned chain.

* * * * *